United States Patent [19]

Quinn

[11] 4,273,290

[45] Jun. 16, 1981

[54] UNITARY VALVE AND SPRING ASSEMBLY

[75] Inventor: David R. Quinn, Pembroke Pines, Fla.

[73] Assignee: The AFA Corporation, Miami Lakes, Fla.

[21] Appl. No.: 92,888

[22] Filed: Nov. 9, 1979

Related U.S. Application Data

[63] Continuation of Ser. No. 851,227, Nov. 14, 1977.

[51] Int. Cl.[3] ..... B05B 1/34

[52] U.S. Cl. ..... 239/493; 239/333

[58] Field of Search ..... 239/493, 490, 491, 330, 239/333, 571; 222/383; 137/DIG. 4, 533; 267/165, 180

[56] References Cited

U.S. PATENT DOCUMENTS

| | | | |
|---|---|---|---|
| 3,112,074 | 11/1963 | Green | 239/493 |
| 3,140,365 | 7/1964 | Voland | 267/165 |
| 3,685,739 | 8/1972 | Vanier | 239/333 |
| 4,082,223 | 4/1978 | Nozawa | 239/333 |
| 4,153,203 | 5/1979 | Tada | 239/333 |

*Primary Examiner*—James B. Marbert

*Attorney, Agent, or Firm*—William R. Wright, Jr.; Thomas W. Brennan

[57] ABSTRACT

A spring-loaded double-ended check valve assembly is provided for use in the outlet chamber of a dispenser for spraying liquids. The entire assembly, including both ends and the spring, is made in one-piece and is easily moldable from plastic material thus effecting ease of manufacture and assembly into the sprayer, reduced labor and material costs and affording the reliability of a unitary member.

10 Claims, 4 Drawing Figures

UNITARY VALVE AND SPRING ASSEMBLY

This is a continuation, of application Ser. No. 851,227 filed Nov. 14, 1977.

BACKGROUND OF THE INVENTION

Sprayers for liquids, particularly, those of the hand-operated trigger type, ordinarily include a check valve in a chamber located just inside the sprayer outlet which serves to block off the inlet passage to the chamber from the interior of the sprayer until the liquid becomes pressurized and to block the passage of liquid from the chamber except to allow it to pass through certain swirl or other passages to the outlet. For instance, U.S. Pat. No. 3,685,739 to Vanier shows a shuttle valve which is free to move in a sprayer outlet chamber wherein upon operation of the sprayer a partial vacuum downstream of the chamber causes it to block the entrance of air through the outlet orifice into the pumping means of the sprayer by closing the liquid supply passage after which the shuttle moves in the opposite direction as the pressure of the fluid in the supply passage builds up and blocks the outlet except for the swirl passages.

Another U.S. Pat. No. 3,061,202 to Tyler shows a check valve which achieves the same general purpose as that of Vanier but is spring-loaded so that it remains on its seat to close the liquid supply passage at all times except when the sprayer is operated to create a sufficient pressure in the supply passage to overcome the spring and thus force the valve to open. Flow of the fluid to be sprayed then occurs, in each instance, to a swirl chamber from which it is sprayed through an outlet orifice. The inlet passage 35 of Tyler is closed by a conical poppet 29 in his showing but flat poppets have been used for this purpose as well. The present invention is an improvement in this art and is distinct from it in that the swirl chamber closure plate, the spring and the poppet are all made of one-piece as a unitary, molded construction thus eliminating the need for three separate parts as shown by Tyler and yet still achieving the same desirable flow and shut-off characteristics. Elimination of the plurality of parts means less assembly time and thus less cost of manufacture, improved simplicity, one-piece reliability and the elimination of compatibility of material problems and problems associated with metal parts such as corrosion for instance.

Another U.S. Pat. No. 3,620,421 to MacGuire-Cooper shows a valve requiring lateral movement of the valve to tilt it on its seat to open the outlet to the flow of a product from its container below the valve. A resilient annular portion is provided which acts to restore the valve to its closed position and this annular portion is molded integrally with the valve portion. In the present invention, on the other hand, the valve is linear in its action and includes an integrally molded sinuous spring which compresses only upon the application of proper operating pressure supplied by the pump action of the sprayer, and, the sinuous spring is carefully designed and molded to operate only when the pressure is sufficient to produce a spray.

OBJECTS OF THE INVENTION

It is, therefore, an object of the present invention to provide a check valve for the exit chamber of a fluid sprayer which includes a sinuous spring and the valve poppet all in one molded piece.

It is also an object of the present invention to provide a check valve as in the foregoing paragraph which includes not only the sinuous spring and valve poppet but also a spin element all in one unitary molded piece.

It is also an object of the present invention to provide a check valve as described in the preceding paragraphs but including a spring in the shape of a letter S.

It is also an object of the present invention to provide a molded one-piece valve, spring and spin element assembly having the reliability of a unitary assembly, ease of manufacture and therefore less costly, resistant to corrosion and having no metal parts.

It is also an object of the present invention to provide a mount for the spin element which prevents possible mold sinks at the center of the spin element.

Other objects and advantages of the present invention will become apparent from the detailed description and claims which follow.

DETAILED DESCRIPTION OF THE INVENTION

Figure 1:
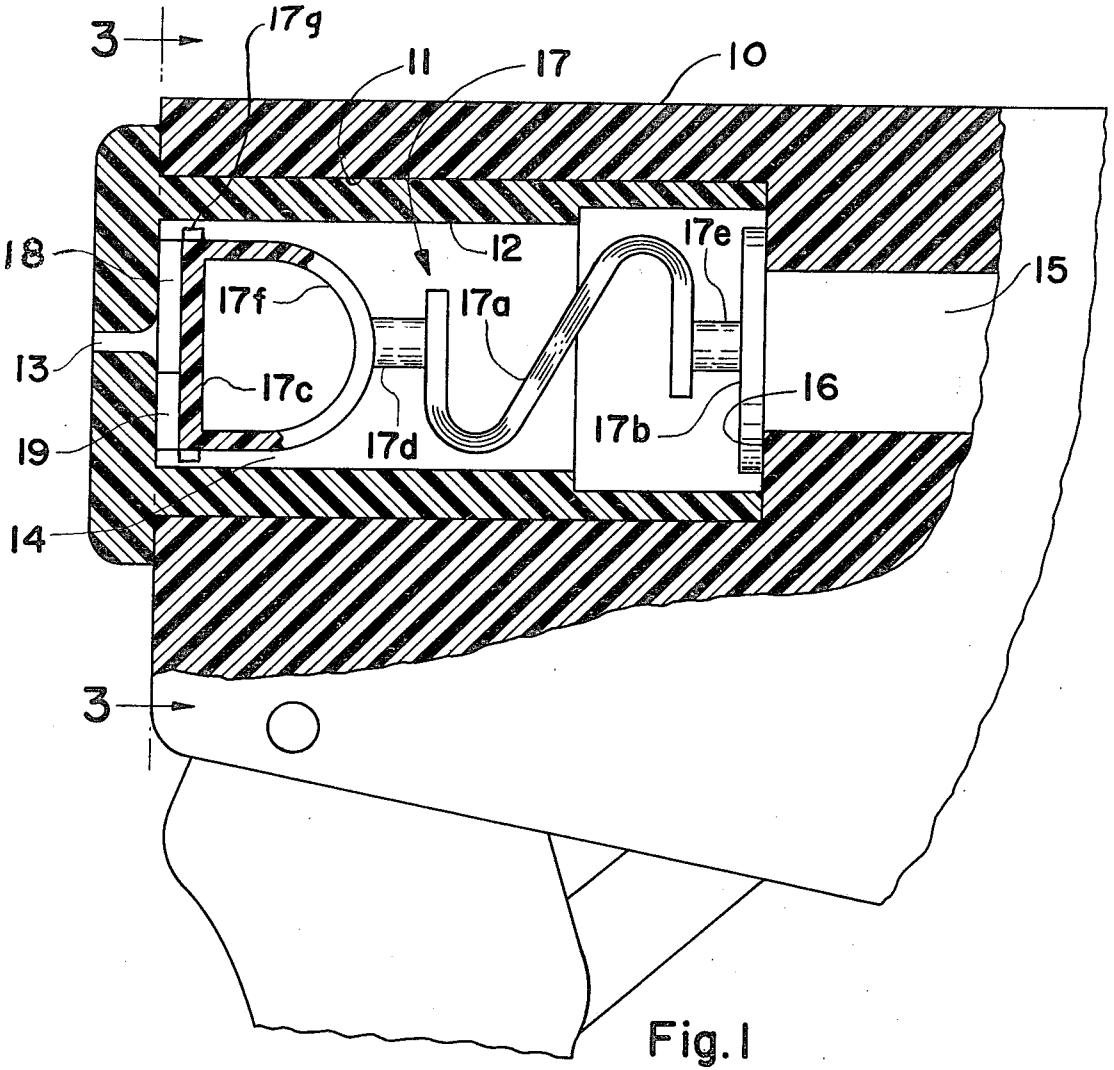
FIG. 1 is a partial cross-section in front elevation of that portion of the sprayer which includes the invention. The unitary assembly including the spring and a portion of the sprayer itself is shown solid and not in cross-section for purposes of clarity. The sprayer is in the normal or at rest condition.

With reference to FIG. 1 of the drawings, a trigger operated pump type sprayer is shown having a body 10 with a cylindrical nose cavity or bore 11 into which a closely fitted nose piece 12 is inserted by a force fit to effect a fluid tight seal therebetween. An outlet or orifice 13 is provided in the front or outer wall of nose piece 12 and the interior of nose piece 12 is hollow as shown to provide a chamber 14. To the right of chamber 14 in FIG. 1, is a passage 15 in body 10 which opens into chamber 14 and defines an annular shoulder 16 in the manner shown. Inside chamber 14, and inserted before nose piece 12 is forced in place, is a unitary molding including a spring, a valve poppet and a swirl chamber cover or spin element all in a one-piece integral molded assembly 17 which, when it is molded, is purposely made longer than chamber 14 so that the spring 17*a* will be slightly compressed between the end walls of chamber 14 when nose piece 12 is put in place in body 10.

The unitary molding 17 includes, as previously mentioned, a spring 17*a* a transversely deployed poppet disc or valve piece 17*b* and a transversely deployed outlet blocking spin element or disc 17*c* all attached together with the spring 17*a* between the other two portions and connected to each of them by molded posts 17*d* and 17*e*. Disc 17*c* is preferably attached to post 17*d* by an arch or arcuate bridge 17*f* which is open at its center and spans disc 17*c* connecting with it near the disc's periphery and with post 17*d* at the peak of its arch. With this construction, the face of disc 17*c* opposite the outlet is kept flat without any possible mold "sink" as its center to cause distortion sufficient to prevent it from seating properly on the outlet wall of chamber 14.

Again with reference to FIG. 1, the inner outlet wall of chamber 14 is plain and flat but disc 17*c* has one or more channel-like passages 18, 19 formed in its face which lead from its outer extremities inwardly toward outlet 13 and communicate with it but are directed tangentially thereto. These are shown more clearly in FIG. 3. Disc 17*c* rests firmly against the face of the outlet wall which acts as a wall to define passages 18, 19 by closing their otherwise open channels to make a four-sided passage or conduit. Disc 17*c*, however, is of smaller diameter than that of the outlet wall so that the outer or end portions of passages 18 remain uncovered and open to chamber 14 but three or more small discs centering integrally molded bosses 17*g* can be used on disc 17*c* spaced equally about its periphery to keep it away from the wall and thus to preclude any possible partial blocking of the fluid by the resting of the disc 17*c* against the inner side wall of nose piece 12 due to non-centering. The overall diameter of the disc 17*c* and the bosses 17*g* is less than the internal diameter of nose piece 12 to allow clearance for free movement of disc 17*c* longitudinally of nose piece 12.

At the opposite end of chamber 14 is a flat, round disc or poppet 17*b* which in the normal and unpressurized condition of the sprayer is urged against annular shoulder 16 by the biasing effect of the slight compression of spring 17*a* to block off passage 15 to prevent the flow of liquid past that location.

Figure 4:
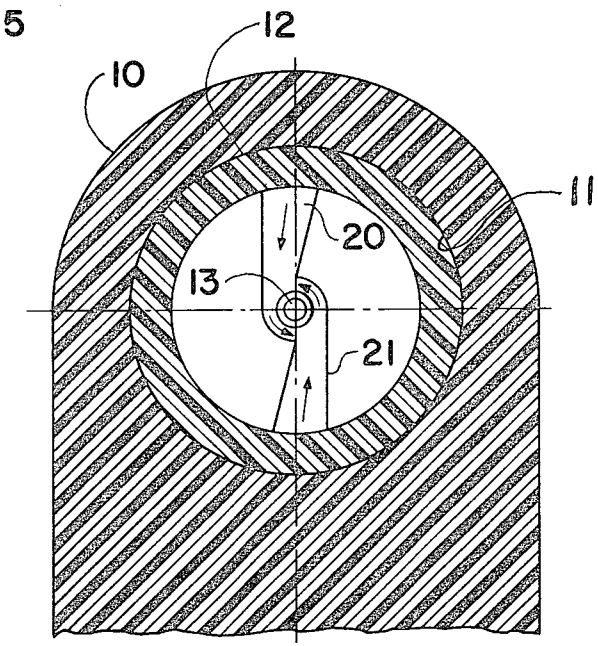
FIG. 4 is a view of the inner side of the outlet wall taken in the direction indicated by the arrows 4—4 in FIG. 2 and showing its swirl passages.

In another version of the nose piece 12, swirl passages 20, 21 are provided in the nose piece 12 itself rather than in the spin element or disc 17*c* as shown in the view of the inner face of the outlet wall in FIG. 4. These passages are again directed tangentially to outlet 13.

OPERATION OF THE INVENTION

Figure 2:
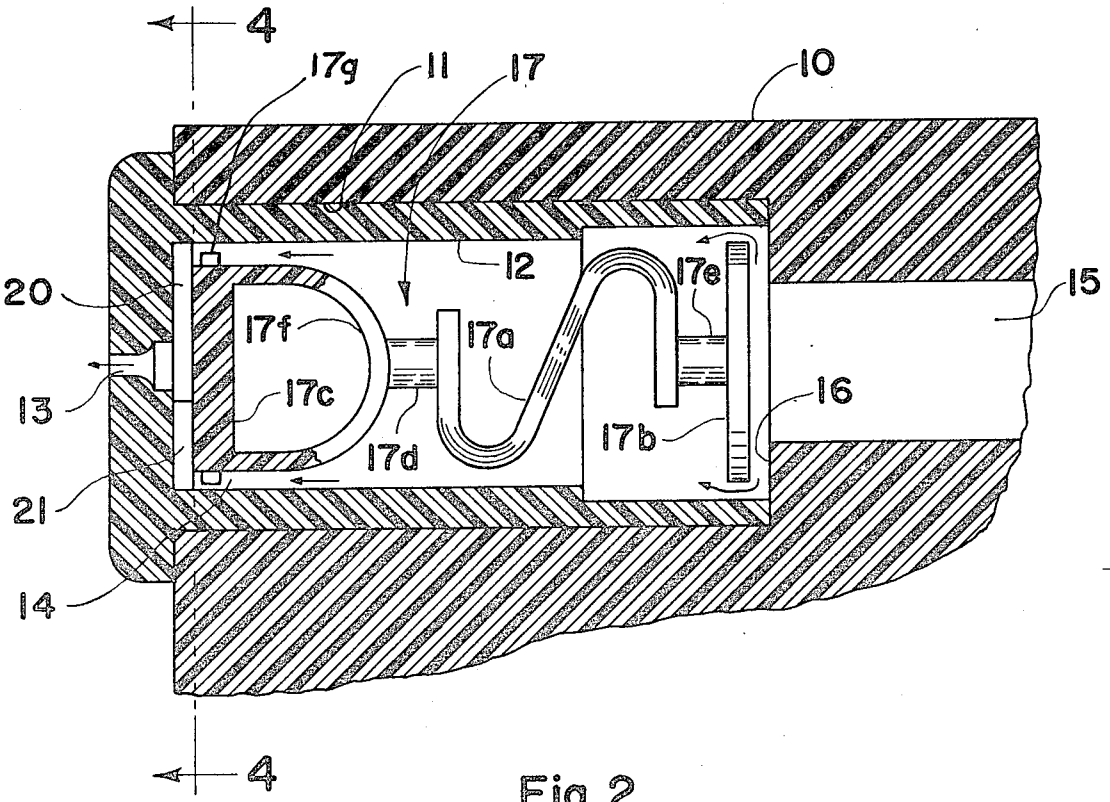
FIG. 2 is a view similar to that of FIG. 1 except that the sprayer is in the pressurized or spraying condition and swirl passages are shown in its nose piece.

With reference to FIG. 1, the sprayer is operated in the usual manner by manipulation of the trigger 22 back and forth to pump liquid up from a container (not shown) into passage 15 where it exerts pressure on valve poppet 17*b*. When this pressure becomes sufficient to further compress spring 17*a*, poppet 17*b* is forced to the left in FIG. 2 leaving annular shoulder 16 and thus permitting pressurized fluid to pass from passage 15 into chamber 14 which it fills. When the chamber 14 is completely filled, the fluid enters swirl passages 20, 21 and enters outlet orifice 13 with a rotary spin or swirl motion induced by the force couple caused by the tangential approach of the fluid through passages 20, 21 to the outlet. The fluid then is forcefully ejected from outlet 13 in a spray due to the pressure upon it and the swirl effect.

When the fluid which was originally pumped into the sprayer from its container becomes exhausted, the trigger is allowed to return to its normal at rest position whereupon a slight vacuum occurs in passage 15 and normal atmospheric pressure inside chamber 14 returns poppet 17*b* to its seat on shoulder 16. The cycle can be repeated again and again to cause the sprayer to spray as desired until the contents of the container is exhausted.

Figure 3:
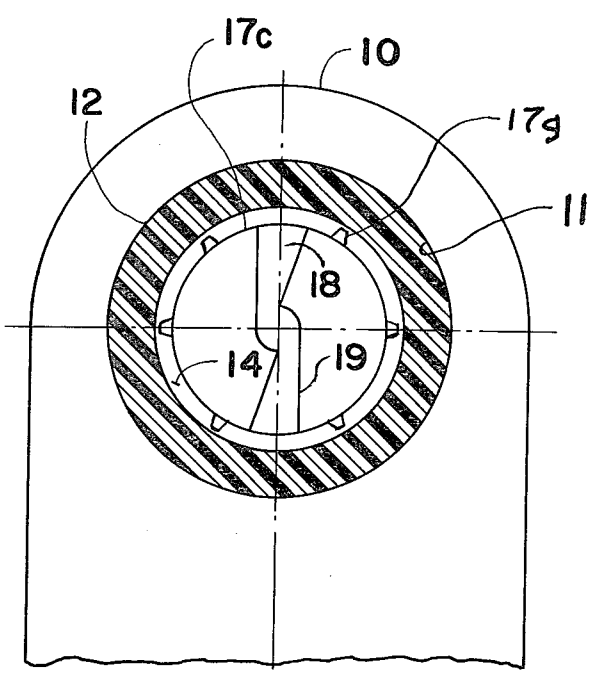
FIG. 3 is a view of the outlet wall side face of spin element 17*c* taken in the direction indicated by the arrows 3—3 in FIG. 1 and showing the swirl passages in its face.

With the configuration shown in FIGS. 1 and 3, the operation is identical with the fluid entering the passages 18, 19 in disc or spin element 17*c* instead of in the nose piece 12 itself.

It is to be noted that the disc 17*b* remains seated on the inside of the outlet wall at all times in both configurations and does not move.

The configuration of the spring 17*a* is preferably that of an S as shown in the drawing but other sinuous spring shapes can be used if desired such as a simple loop, split S, double S, helix or other sinuous shape providing that it fits within the chamber 14 without binding or interference with its walls, particularly when compressed. The spring rate or force required to compress the spring can be varied during the molding of the assembly by altering the molding dies to provide various dimensions for the spring and also by the use of various materials with different elastic properties or tensile strengths. It can, for instance, be made weaker by making the spring narrows or thinner or stronger by increasing its width and thickness.

It is preferred that the assembly be molded of a plastic material such as polypropylene or polyethylene but other plastics can be used provided that they have the qualities required to provide compatibility with the fluids being sprayed, dimensional stability sufficient to prevent undue changes in the spring characteristics, to prevent binding in chamber 14 or to prevent changes in flatness, the resiliency needed to provide the spring effect, and, good moldability.

While there have been shown and described and pointed out the fundamental novel features of the invention as applied to a preferred embodiment, it will be understood that various omissions and substitutions and changes in the form and details of the device illustrated and in its operation may be made by those skilled in the art, without departing from the spirit of the invention. It is the intention, therefore to be limited only as indicated by the scope of the following claims.

What is claimed is:

1. An assembly formed as a unitary molding including a sinuous spring member having opposite ends, a flat faced valve member connected to one of said opposite ends of said spring member and deployed transversely with respect thereto, a spin element comprising a flat plate deployed transversely with respect to said spring member and connected to the other of said opposite ends of said spring and, an arched bridge connecting said spin element to said other opposite end of said spring member.

2. An assembly formed as a unitary molding including a sinuous spring member, a flat faced valve member, a spin element connected to said spring member comprising a plate having a central, circular open chamber and at least two open channels communicating with said chamber and laterally co-extensive with the outside dimension of said plate, said channels tangentially aligned with said chamber on said opposite sides thereof, said spring member being connected at one end thereof to said valve member and at the other end thereof to said spin element, said valve member and said spin element both deployed transversely with respect to said spring member, and an arched bridge connecting said spin element to said spring member.

3. A fluid dispenser including component retaining body means, means in said body means defining an orifice through which fluid pumped from a fluid supply is ejected, inlet means and outlet means in said body means for controlling the flow of fluid through said orifice, said outlet means including an "S" shaped compression spring, and a spray producing means in said body means operably associated with said orifice, said spray producing means and said "S" shaped spring being combined in a single molding, said spray producing means further including a spin element for producing swirling of the fluid as it passes into and through said orifice.

4. For use in a fluid dispenser having a conduit terminating in a walled exit chamber formed at the end of said conduit through which fluid flows for ejection in a spray from an orifice located in the wall of said chamber when pumped therethrough from a supply of fluid, an assembly for controlling the flow of fluid in said conduit and ejecting said fluid from said orifice in a spray, said assembly comprising a unitary molding including, as integral portions thereof, poppet valve means in said chamber for shutting off fluid flowing thereinto from said conduit, a spin element disposed in said chamber oppositely from said poppet valve means, a sinuous compression spring member in said chamber extending between said poppet valve means and said spin element for urging said poppet valve means toward said conduit end and said spin element toward said orifice located in said wall of said chamber and, an integrally molded arched bridge connecting said spin element to said spring member in spaced relation therewith.

5. The assembly as in claim 4 in which said poppet valve means is connected to and spaced from said spring member by an integrally molded post.

6. The assembly as in claim 4 in which said spin element is connected to said arched bridge and to said spring member by an integrally molded post.

7. The assembly as in claim 4 in which said poppet valve means is generally disc shaped and has a flat surface extending transversely with respect to said member, said surface under urging of said poppet valve means by said member closing said conduit end and shutting off flow of fluid thereat.

8. The assembly as in claim 4 in which said spin element is disc shaped and said arched bridge extends between said sinuous spring member and said element being connected thereto on the periphery of said disc.

9. The assembly as in claim 3 wherein said arched bridge is connected to said sinuous spring member by a molded post.

10. The assembly as in claim 7 wherein said sinuous spring member is connected to said arched bring substantially at the top of its arch.

* * * * *